US007663462B2

(12) United States Patent
Makuth et al.

(10) Patent No.: US 7,663,462 B2
(45) Date of Patent: Feb. 16, 2010

(54) INDUCTIVE ROTATING TRANSMITTER

(75) Inventors: Jens Makuth, Feucht (DE); Jürgen Schimmer, Nürnberg (DE)

(73) Assignee: Siemens Aktiengesellschaft, Munich (DE)

( * ) Notice: Subject to any disclaimer, the term of this patent is extended or adjusted under 35 U.S.C. 154(b) by 680 days.

(21) Appl. No.: 10/571,281

(22) PCT Filed: Sep. 21, 2004

(86) PCT No.: PCT/EP2004/010581

§ 371 (c)(1),
(2), (4) Date: Mar. 9, 2006

(87) PCT Pub. No.: WO2005/031770

PCT Pub. Date: Apr. 7, 2005

(65) Prior Publication Data

US 2007/0024575 A1 Feb. 1, 2007

(30) Foreign Application Priority Data

Sep. 23, 2003 (DE) ..... 103 44 055

(51) Int. Cl.
*H01F 21/06* (2006.01)

(52) U.S. Cl. ..... 336/130

(58) Field of Classification Search ..... 336/115–118, 336/130–135, 200, 225, 229
See application file for complete search history.

(56) References Cited

U.S. PATENT DOCUMENTS

| | | | | |
|---|---|---|---|---|
| 4,754,180 | A * | 6/1988 | Kiedrowski | 310/90.5 |
| 4,827,360 | A | 5/1989 | Kawasaki et al. | |
| 5,347,256 | A * | 9/1994 | Yumiki et al. | 336/84 C |
| 5,412,366 | A | 5/1995 | Ohji et al. | |
| 5,455,729 | A | 10/1995 | Nelson et al. | |
| 5,572,178 | A * | 11/1996 | Becker et al. | 336/120 |
| 5,814,900 | A | 9/1998 | Esser et al. | |
| 6,512,437 | B2 | 1/2003 | Jin et al. | |
| 6,556,165 | B2 | 4/2003 | Fukushima et al. | |
| 6,559,560 | B1 | 5/2003 | Jin et al. | |
| 6,915,558 | B2 | 7/2005 | Jin et al. | |
| 6,950,633 | B2 * | 9/2005 | Kojima et al. | 455/73 |
| 7,304,559 | B2 * | 12/2007 | Fortsch et al. | 336/234 |

FOREIGN PATENT DOCUMENTS

| | | |
|---|---|---|
| DE | 3908982 A1 | 9/1990 |
| DE | 102 30 537 A1 | 1/2004 |
| EP | 0 926 690 A1 | 6/1999 |
| EP | 1 005 052 A1 | 5/2000 |
| EP | 1 241 732 A1 | 9/2002 |
| FR | 2428821 | 1/1980 |

* cited by examiner

*Primary Examiner*—Tuyen Nguyen

(57) ABSTRACT

The invention relates to an inductive rotating transmitter, comprising a fixed piece and a rotating piece, whereby the fixed piece and the rotating pierce have a common virtual rotational axis and the rotating piece rotates about the fixed piece. The data transmission is carried out over at least one data transmission path by means of at least one inductive element and the data transmission path is arranged outside the rotational axis of the rotating transmitter.

12 Claims, 4 Drawing Sheets

INDUCTIVE ROTATING TRANSMITTER

CROSS REFERENCE TO RELATED APPLICATIONS

This application claims priority to the German application No. 10344055.0, filed Sep. 23, 2003 and to the International Application No. PCT/EP2004/010581, filed Sep. 21, 2004 which are incorporated by reference herein in their entirety.

FIELD OF INVENTION

The invention relates to an inductive rotary transducer.

BACKGROUND OF INVENTION

Data and energy transmission (Telemetry) to moving machine parts is a central problem above all in industry and in particular with and/or in distributed automation systems. Production processes, especially for example in the case of machine tools, robots, etc. are carried out on rotating or generally moving work parts, or the tools rotate and/or move around the work part that is to be processed. In such systems, data networks, among other things, are required in order to transmit data. To this end, for instance bus systems such as, for example, Field Bus, Profibus, Ethernet, Industrial Ethernet, or FireWire, but increasingly also switchable high-performance data networks, i.e. point-to-point connections, in particular real-time Ethernet (RTE) or also isochronous RTE (IRTE) are used.

SUMMARY OF INVENTION

Nowadays, data transmission is realized either with conventional trailing cable installations or mechanical slip rings. Though there are also capacitive and optical methods, these, however, entail technical limitations or problems of cost. Radio does not come into this at all so far because of low net data rates and additional protocol layers, but also because of electromagnetic compatibility (EMC) and for reasons of reliability.

The trailing cable installation solution prevents a continuous rotation and limits production speed because reverse rotation of, for example, the tools is necessary (to avoid shearing the cable). The minimization of the non-productive times in the system, however, plays a significant role in terms of productivity. A preferred solution for this problem of non-productive time is to replace the trailing cable installations with a rotary transducer.

Rotary transducers are available in a wide variety of designs. Contact transducer can be used, e.g. mechanical slip rings, brushes or liquid mercury transducers as well as non-contact transducers, such as, for example optical, capacitive, inductive transducers or transducers based on radio transmission.

When conventional, mechanical slip rings are used, problems arise in relation to wear and tear, EMC and reliability, one of the reasons for this being that the energy itself is transmitted in the direct vicinity.

Capacitive transducers are expensive and are used, for example, for military applications.

For hard-wired systems (buses or point-to-point connections) there is as yet no ideal solution. A reasonably priced device, which enables a transparent (without additional protocol layer), bidirectional and full duplex-data transmission, and which can be used in the principally different bus protocols, does not exist at present.

A fiber-to-air-to-fiber coupling, which would be available in the form of FORJs (Fiber Optic Rotary Joints) with fiber optic connection, entails significantly greater costs. Such FORJs have, for example, passive optical elements and, because of the correspondingly high requirements, must also be equipped with expensive mechanics, in particular bearing technology. Until now, these have only been built manually in small scale production and are essentially made of high-grade steels. In addition to the very high costs there are also technical limitations, e.g. data transfer rates, vibrations, rotational speed, temperature, etc.

Transmission systems are known from video technology, which transmission systems use transformers to inductively transmit or couple from moving to non-moving components, for example, a video head.

In variations or with new manufacturing technologies, this transmission system can also be used for rotary transducers.

Rotary transducers can further be subdivided into on-axis or off-axis systems. In the case of on-axis systems, the rotational axis of the rotary transducer is reserved as the data transmission path for transmitting the data. This latter is the subject matter of the invention relating to an optical rotary transducer, in the, at the time of the application, unpublished German patent application DE 10230537.4 of the applicant.

The disadvantage with on-axis systems is in particular the preallocation of the space of or around the rotational axis for the data transmission, if this space is to be used or is required for lead-throughs for, for example, cables, pneumatics, hydraulics, etc. instead of for the data transmission.

An object of the present invention is to specify a rotary transducer, in which the data transmission takes place by means of inductive elements and outside the area of the rotational axis of the rotary transducer.

This object is achieved by means of an inductive rotary transducer for transmitting data, comprising a fixed part and a rotating part, with the rotating part and the fixed part comprising a common virtual rotational axis, and with the rotating part rotating about the fixed part, and with the data transmission being carried out over at least one data transmission path by means of at least one inductive element, and with the data transmission path being arranged outside the rotational axis of the rotary transducer.

The two parts of the rotary transducers, the fixed and the rotating part, have a common virtual rotational axis, with the rotating part rotating around this virtual rotational axis and the rotation being possible in any direction. The rotary transducer preferably comprises a housing which is rotationally symmetrical to the virtual rotational axis, said housing also includes the corresponding mechanics with housing, bearing arrangement and sealing.

Since the data transmission path is inventively arranged outside the rotational axis, it is especially advantageous if the inductive rotary transducer has a housing which has a lead-through that surrounds the virtual rotational axis. The inductive rotary transducer has, at the site of the rotational axis, space for realizing the lead-through, as the data transmission takes place outside this space. For example, the housing of a hollow cylinder design makes it possible to use the space around the rotational axis for lead-throughs. The space available within the lead-through can be used for cables, pneumatics or hydraulics for example.

In an advantageous embodiment of the inductive rotary transducer according to the invention, the inductive element is designed as a transformer with at least one first and one second coil, with the first coil being allocated to the fixed part and the second coil to the rotating part. With an embodiment of this kind, the first coil is to be regarded as the primary winding of the transformer for example and the second coil as the secondary winding of the transformer. The allocation of the primary and secondary windings is, of course, interchangeable as desired. The first coil can also be allocated to the rotating part and the second coil to the fixed part.

In order to realize an inductive rotary transducer according to the invention, a method known per se, such as, for example, the video head method, is modified accordingly in a new application. New manufacturing technologies are used to produce subcomponents.

In order to realize the rotary transducer according to the invention with the smallest possible diameter, the first and the second coil lend themselves to being arranged next to each other in relation to the direction of the virtual rotational axis.

In contrast, the rotary transducer can be advantageously realized with a very small installation depth by arranging the first coil coaxially around the second coil.

In particular when the housing of the rotary transducer is constructed essentially in a rotationally symmetrical manner, an advantageous design is given through the fact that the first and/or the second coil are realized as a toroid coil. An arrangement of this kind can also be referred to as a toroidal transformer with windings which can be moved towards each other.

A particularly compact construction method of the inductive rotary transducer can be realized by using especially flat coils for the inductive rotary transducer. A very advantageous embodiment of the invention is characterized in this sense that the first and/or the second coil are realized as a planar coil. Planar coils are especially suitable for a miniaturization of the inductive rotary transducer according to the invention.

Using replicating techniques or methods such as, for example, injection molding or MID (molded interconnect device), which are also used for example in microsystems engineering, both miniaturization and also cost-effective production of a rotary transducer according to the invention is achieved. In particular by the miniaturization of the rotary transducer, use is conceivable and possible in further potential areas of application, e.g. robot joints, where lead-throughs are required to supply power for instance.

In order to minimize the leakage flux of the inductive element, it is advisable for the inductive element to have means for field concentration. Such means could be, for example, ferrites placed in suitable positions to direct the magnetic flux. A strong field coupling between primary and secondary winding is important for an efficient inductive data transmission. A pot or cup core can also be used for the coupling of the first and the second coil of the transformer. Various other embodiments for creating as big a coupling factor as possible between primary and secondary winding using field concentration are of course also conceivable.

The inductive rotary transducer according to the invention is not limited to use strictly as an inductive element. In many applications of data transmission it is practical for the transducer to be provided for bidirectional data transmission and has an inductive element for each transmission direction. Alternatively, it is possible to use only one inductive element, if a so-called terminating set is used.

When two inductive elements are used, different geometrical arrangements of the inductive elements are possible. When the inductive elements are arranged next to each other in relation to the direction of the virtual rotational axis, the smallest possible diameter of an inductive rotary transducer is achieved with two or also more than two inductive elements.

On the other hand, an inductive rotary transducer can be realized with the smallest possible installation depth, when the inductive elements are arranged coaxially nested in each other. In order to separate the channels to which the different inductive elements are allocated, it is advantageous to use means for field concentration in order to largely avoid a magnetic coupling through leakage flux of the inductive elements among each other.

In order to separate the channels when using several inductive elements, it is, in addition, advisable, to arrange means for decoupling magnetic fields between the inductive elements. The means for decoupling the magnetic fields can be simple geometric arrangements, which are delegated between the inductive elements and there ensure a minimum spacing between the inductive elements.

A particularly advantageous application for the transducer according to the invention occurs when the tranducer is provided for the transmission of bus protocols, in particular Fast Ethernet protocols.

Different bus protocols, such as Profibus and (Fast) Ethernet for example, can be transmitted without any great fundamental changes. The focus here is in particular on rotary transducers for Fast Ethernet, i.e. for a data transfer rate of 100 Mbaud. By modifying the input or output circuit, it would also be possible to transfer other bus protocols, in particular other field bus protocols.

A further advantage is the transparency in the data transmission. Additional protocol layers are not necessary.

Furthermore, without any great fundamental changes, different protocols, in particular, protocols low in direct current, can be transmitted using the inductive rotary transducer according to the invention. Even NRZ coded data streams (NRZ=non return to zero), which contain a direct current component, can be used for passive transmission for example, if a corresponding code conversion to a RZ Code (RZ=return to zero) is carried out in the rotary transducer.

In order to achieve as cost-effective a production as possible of the inductive or field coupled rotary transducer, it is advantageous that said transducer operates passively. An active variant, which realizes signal conditioning at the input and/or output side, is of course also conceivable and possible. In the realization of this variant, additional delay times or jitters, which are added to the signal propagation time, must be taken into consideration.

As a preferred embodiment the field coupled, or passive rotary transducer according to the invention is executed as an integrated unit. Elements to be connected externally are the corresponding bus cables on both sides. Here, a preferred embodiment allows the use of plug connections. In the case of a corresponding preparation in the fixed part or in the rotating part of the optical rotary transducer, the method for transmitting data is then achieved in a very simple and cost-effective manner. In principle, all possible data buses, for example, Ethernet, in particular field buses, for example Profibus, but also point-to-point connections, for example, IRTE, can hereby be connected, the corresponding data protocols can be transmitted and hence the inductive rotary transducer according to the invention can be integrated into any automation systems.

It is furthermore particularly advantageous that the invention can be applied or used in particular with and in packaging machinery, molding presses, plastic molding machinery, textile machinery, printing machinery, tooling machinery, robots, handling systems, wood working machinery, glass processing machinery, ceramics processing machinery as well as lifting equipment.

BRIEF DESCRIPTION OF THE DRAWINGS

Preferred exemplary embodiments of the invention are explained in greater detail below with reference to the drawings, in which.

DETAILED DESCRIPTION OF INVENTION

Figure 1:
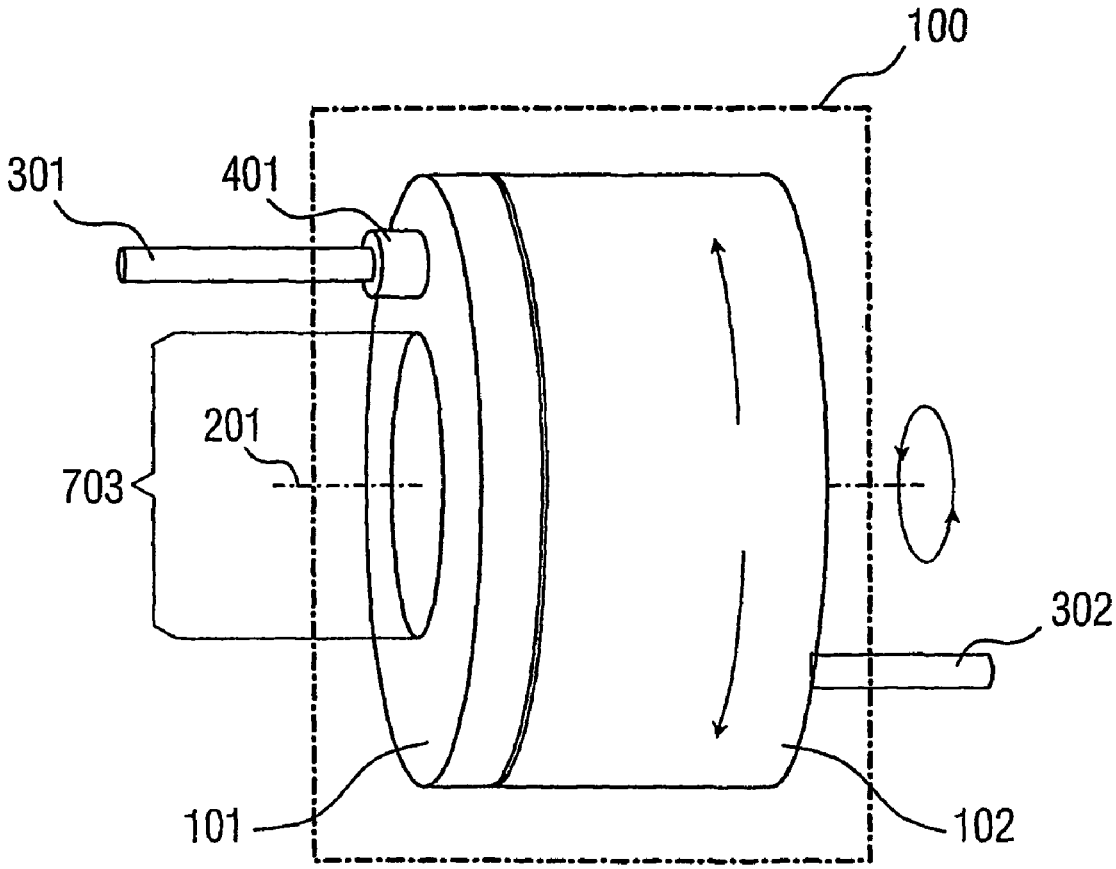
FIG. 1 shows a schematic drawing of a rotary transducer.

FIG. 1 shows a schematic drawing of a rotary transducer 100. The rotary transducer 100 consists of a fixed part 101 and a rotating part 102. Both parts of the rotary transducer 100 have a common, imaginary, virtual rotational axis 201, with the rotating part 102 rotating about this virtual rotational axis 200, with any direction of rotation. As a result of the rotation about the virtual rotational axis 201, the housing of the rotary transducer 100 is preferably executed rotationally symmetrical, for example cylinder-shaped, to the rotational axis 201. The fixed part 101 is also described in the mechanical sense as "stator" and the rotating part 102 as "rotor". It is thereby irrelevant which part moves and which part of the rotary transducer 100 is fixed. Only one part of the rotary transducer 100 is ultimately allowed to be fixed mechanically rigid, the other, second part must be disposed in a stress-free rotatable manner and must be able to be "driven stress-free". This can be achieved, for example, by means of a plastic or rubber coupling. Other sealings are, however, also conceivable and possible. Depending on the design, any grade of sealing is thereby achievable. In addition, the maximal rotational speed depends among other things on the quality of the bearing.

Rotary transducers are used in particular for data transmission, with corresponding cables 301, 302 leading into the two parts 101, 102 of the rotary transducer 100, with a cable 302, as shown in FIG. 1, rotating along with the rotating part 102 of the rotary transducer 100 for example. In principle all kinds of suitable cables are possible for the data transmission, for example bus cables, optic fibers, etc. The cables are preferably connected with the rotary transducer 100 by means of plugs, of which only plug 401 is visible in FIG. 1. Naturally the shape of the plug is essentially any desired.

The two housing parts of the rotary transducer 100 can be manufactured from steel for example, especially high-grade steel, from ceramic or from plastic. However, other materials, are also conceivable and useable, for example aluminum alloys, brass, etc. In order to lower the production costs, or to be able to apply cost-effective production methods, which further reduce the manufacturing costs, preference is given to the use of reasonably priced materials, ceramics or plastics for instance. By that means, in particular through the use of plastics, correspondingly cost-effective manufacturing technologies, the injection molding technique for example, can be employed.

Figure 2:
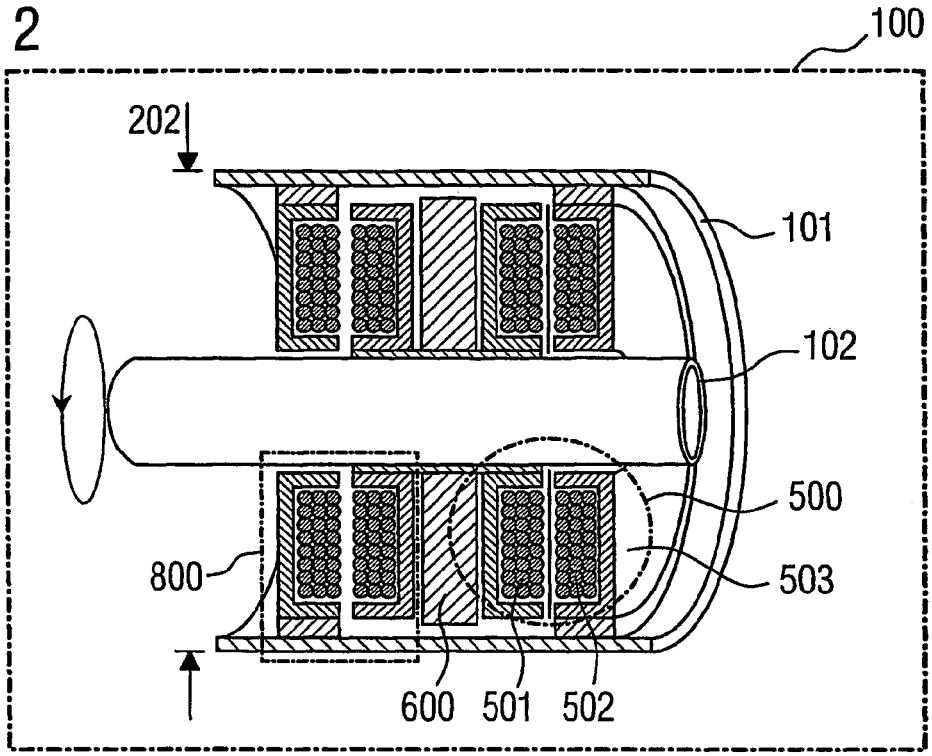
FIG. 2 shows a schematic drawing of an inductive rotary transducer according to the invention, axial version.

FIG. 2 shows a schematic drawing of an inductive rotary transducer according to the invention 100 in an axial version, which works with the conventional coil method, in particular conventional windings. The inventive field coupled rotary transducer 100 consists in principle of two pipes 101,102 that can be turned in relation to each other.

The rotary transducer 100 has two inductive elements 500, 800 for data transmission, whereby one channel is allocated to each element. One inductive element 500, 800 consists of two coils 501, 502 or coil parts with pot or cup cores 503, for example with a ferrite pot, which coils are separated from each other by an air gap.

The inductive elements 500, 800 lie axially beside each other, which makes possible a construction that has a small diameter 202. Between the inductive elements 500, 800 there is a "spacer" 600 which serves as the separation of the channels, and hence, in particular to prevent the field coupling between the inductive elements 500, 800.

Figure 3:
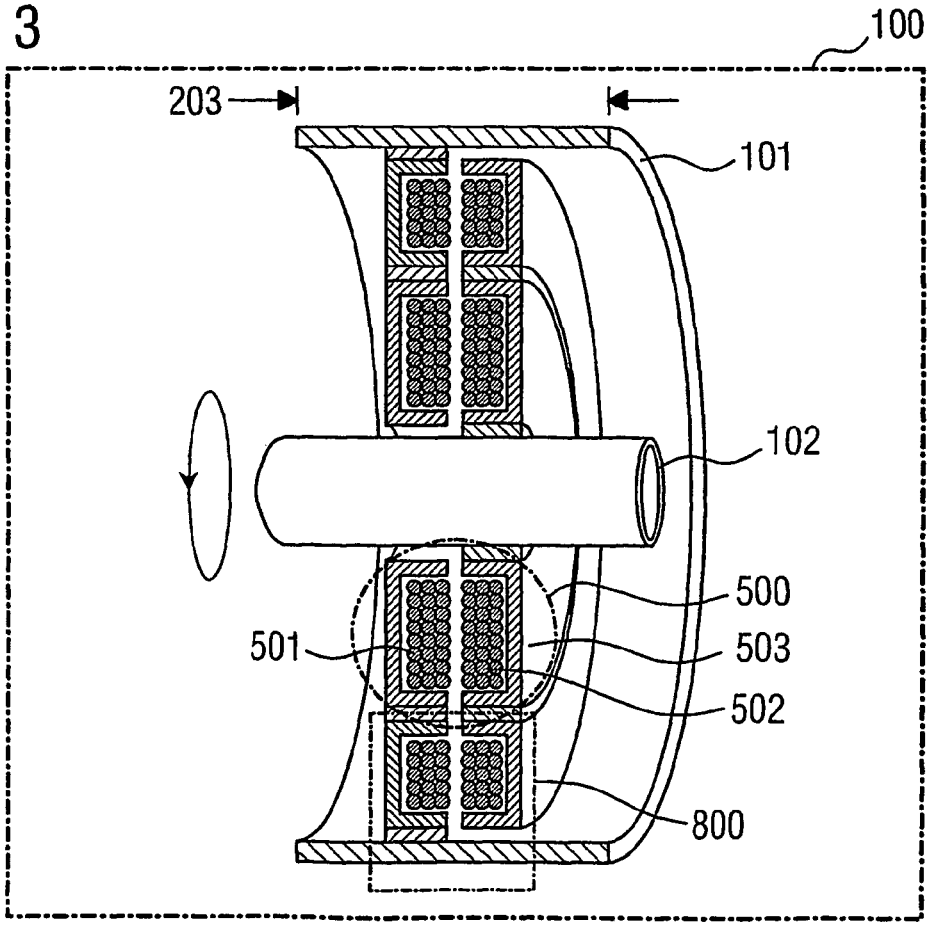
FIG. 3 shows a schematic drawing of an inductive rotary transducer according to the invention, radial version.

FIG. 3 shows a schematic drawing of an inductive rotary transducer according to the invention 100 in a radial version, which transducer works with conventional coil method. In principle, it consists of two pipes 101,102 that can be turned in relation to each other.

The rotary transducer 100 has two inductive elements 500, 800 for data transmission, with one channel being allocated to each element 500, 800. An inductive element 500, 800 consists of two coils 501, 502 or coil parts with pot or cup cores 503, for example with a ferrite pot, which coils are separated from each other by an air gap.

The channels or the inductive elements 500, 800 lie radially next to one another, which allows for a construction that has a small diameter 203. There can again be a spacer between the channels, which spacer improves the separation of the channels.

Figure 4:
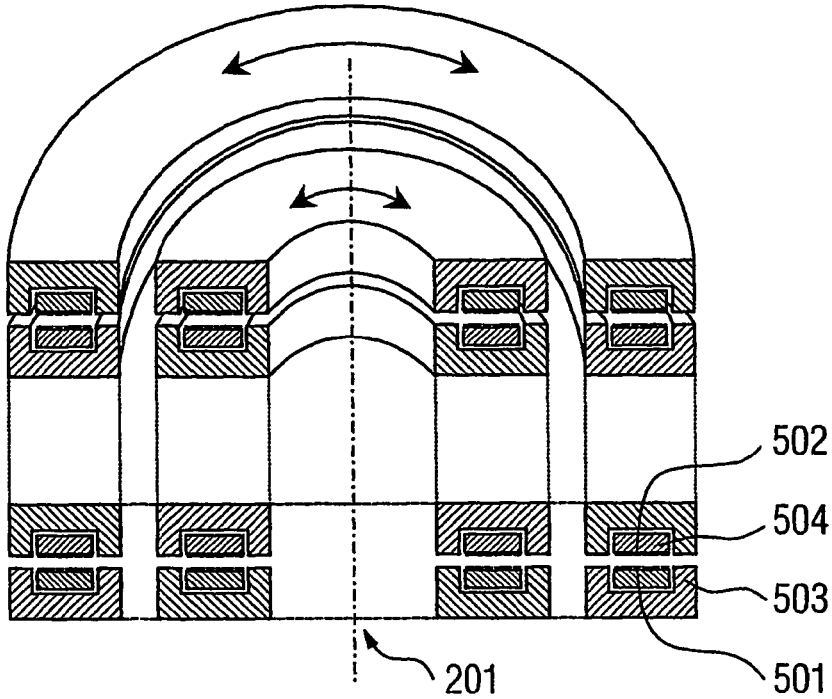
FIG. 4 shows a schematic drawing of an inductive rotary transducer according to the invention with planar coils.

FIG. 4 shows a schematic drawing of an inductive rotary transducer according to the invention with planar coils 501, 502. In principle, these coils are manufactured like circuit boards, i.e. conductor paths on carrier material 504, using the processes of conventional circuit board production. The properties of the coils 502, 503 can easily be calculated or simulated using mechanical parameters. The finished planar coil 502, 503 has then only to be embedded in pot or cup cores 503. The planar coils 502, 503 are again physically separated from each other by an air gap.

Figure 5:
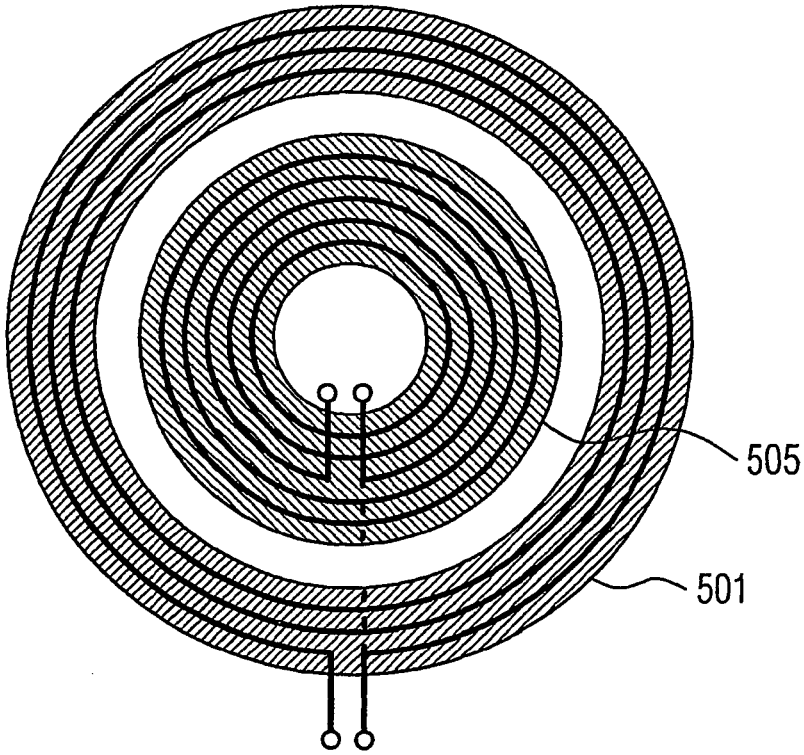
FIG. 5 shows a schematic drawing of a planar coil construction and FIG. 6 shows a schematic drawing of an inductive rotary transducer according to the invention as MID variant (molded interconnect device).

FIG. 5 shows a schematic drawing of a planar coil construction. The properties of the coils 501, 505 are largely determined by their geometry. In principle, identical coil surfaces with identical cross-sectional conductor area are necessary for radially arranged coils with identical inductivity.

Figure 6:
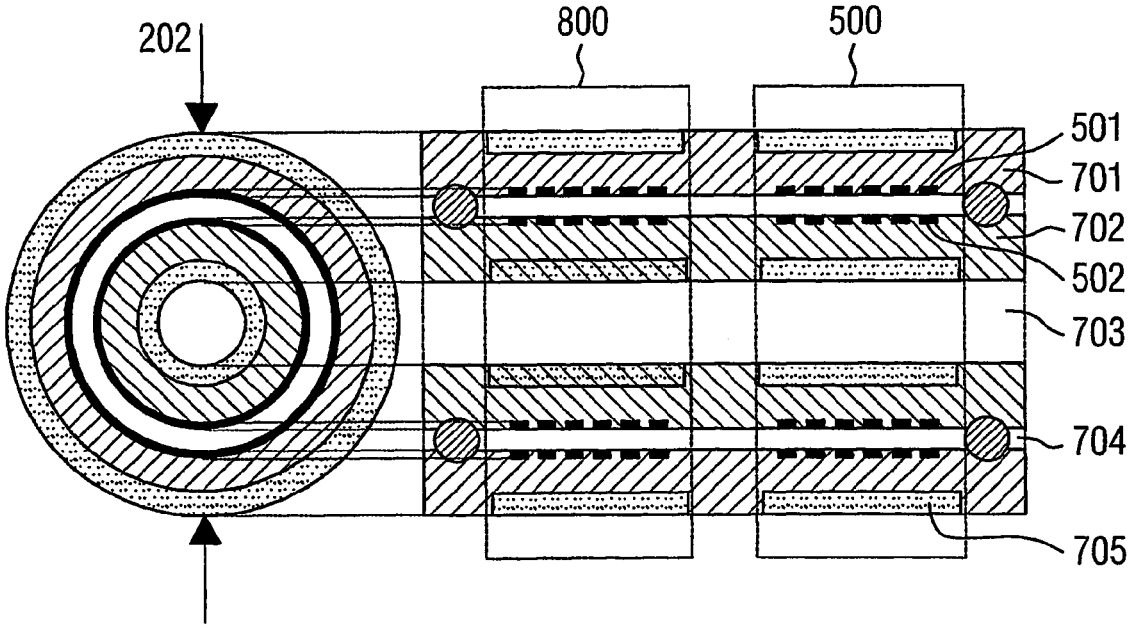

FIG. 6 shows a schematic drawing an inductive rotary transducer according to the invention as a MID variant (molded interconnect device). The MID variant offers the greatest potential for low-cost and miniaturization.

This embodiment according to the invention has one inductive element 500, 800 respectively with an inner coil form 702 and an outer coil form 701, whereby the outer coil form 701 encloses the inner coil form 702 concentrically. Coils 501 are embedded in the outer coil form 701 and the windings of said coils 501 are arranged next to each other in an axial direction, i.e. in the direction of the virtual rotational axis. Analogously the coils 502 are embedded in the inner coil form 702, and the windings of said coils 502 are arranged next to each other in an axial direction, i.e. in the direction of the virtual rotational axis. This arrangement of the windings makes it possible for the inductive rotary transducer to be realized with an especially small diameter 202.

The coils 501 of the outer coil form 701 can be regarded as the primary winding of a transformer, of which transformer the secondary winding are represented by the coils 502 on the inner coil form 702. Corresponding means 705, e.g. HF magnets are provided both in the inner coil form 702 and on the outer coil form 701 for the purposes of field concentration.

The primary and secondary windings of the inductive element 500 are separated by an air gap 704, within which air gap there is also a bearing arrangement provided which enables rotation of one of the coil forms 701, 702.

The rotary transducer is executed with two inductive elements 500, 800 arranged axially beside each other thus creating two transmission channels. The number of channels or of inductive elements is, of course, scalable.

The manufacture of the rotary transducer is particularly cost-effective. The HF magnets 705 and the coils 502 are positioned and extrusion coated with plastic. Further treatment of auxiliary structures such as, for example, etching (in the sense of removal) is also possible. At the same time the seats for the bearing arrangement can be produced. In a fully developed process, only a few steps are necessary to manufacture the entire structure.

The invention claimed is:

1. An inductive rotary transducer for transmitting data, comprising:

a fixed part;

a rotating part rotating about the fixed part;

a common virtual rotational axis shared by the rotating and fixed parts; and a first and a second inductive element for bidirectional data transmission via at least one data transmission path, the data transmission path arranged outlying the common virtual rotational axis, wherein the first inductive element is configured to transmit data and the second inductive element is configured to receive data, and wherein the first inductive element is arranged adjacent to the second inductive element relative to the virtual rotational axis.

2. The inductive rotary transducer according to claim 1, further comprising a housing having a duct enclosing the virtual rotational axis.

3. The inductive rotary transducer according to claim 1, wherein the inductive element is a transformer comprising at least first and second coils assigned to the fixed respectively rotating part.

4. The inductive rotary transducer according to claim 3, wherein the first coil is arranged adjacent to the second coil relative to the virtual rotational axis.

5. The inductive rotary transducer according to claim 3, wherein the first coil is arranged coaxially around the second coil.

6. The inductive rotary transducer according to claim 3, wherein the first or the second coil is a toroidal coil.

7. The inductive rotary transducer according to claim 3, wherein the first or the second coil is a planar coil.

8. The inductive rotary transducer according to claim 1, wherein the inductive element comprises a device for concentrating a magnetic field generated by the inductive element.

9. The inductive rotary transducer according to claim 8, further comprising a decoupling device arranged between the first and second inductive elements for separating a first magnetic field generated by the first inductive element from a second magnetic field generated by the second inductive element.

10. The inductive rotary transducer according to claim 1, wherein the inductive rotary transducer is configured to transmit data according to a bus protocol.

11. The inductive rotary transducer according to claim 10, wherein the bus protocol is a Fast Ethernet protocol.

12. The inductive rotary transducer according to claim 1, wherein the inductive rotary transducer forms one integrated unit.

* * * * *

UNITED STATES PATENT AND TRADEMARK OFFICE

CERTIFICATE OF CORRECTION

PATENT NO. : 7,663,462 B2
APPLICATION NO. : 10/571281
DATED : February 16, 2010
INVENTOR(S) : Makuth et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1000 days.

Signed and Sealed this

Thirtieth Day of November, 2010

David J. Kappos

David J. Kappos
*Director of the United States Patent and Trademark Office*